United States Patent [19]

van der Weide

[11] Patent Number: 4,641,826

[45] Date of Patent: Feb. 10, 1987

[54] MACHINE DESIGNED TO LIFT A FLEXIBLE, FLAT WORKPIECE OFF A SUPPORT SURFACE

[75] Inventor: Egbert J. van der Weide, GW Olst, Netherlands

[73] Assignee: Beisler GmbH, Fed. Rep. of Germany

[21] Appl. No.: 745,296

[22] Filed: Jun. 14, 1985

[30] Foreign Application Priority Data

Jun. 15, 1984 [DE] Fed. Rep. of Germany ..... 3422337

[51] Int. Cl.[4] ..... B65H 3/22

[52] U.S. Cl. ..... 271/18.3; 294/61

[58] Field of Search ..... 271/18.3, 16, 18, 19, 271/42, 118, 119, 120, 141, 142, 144, 161, 168, 204, 206, 209; 294/61

[56] References Cited

U.S. PATENT DOCUMENTS 3,402,833 10/1968 Pershing ..... 294/61

3,813,094 5/1974 Walton et al. ..... 271/18 X 4,008,888 2/1977 Vinciguerra ..... 271/18.3

*Primary Examiner*—Douglas C. Butler

*Assistant Examiner*—Matthew C. Graham

*Attorney, Agent, or Firm*—Harness, Dickey & Pierce

[57] ABSTRACT

A machine is disclosed for lifting flexible flat workpieces such as fabric from a support surface. The machine includes a needle holder onto which a circular needle is mounted. The leading edge of the needle holder initially extends through a slit in the housing to push down on the workpiece when the machine is first placed thereon to prevent folds from occurring in the slit. Thereafter, the needle holder is rotated so that the circular needle perforates the top workpiece whereby the machine can be raised to lift the workpiece and move it to a desired location. When the needle holder returns to its rest position the needle is pulled out of the workpiece allowing it to fall from the grasp of the machine.

12 Claims, 8 Drawing Figures

MACHINE DESIGNED TO LIFT A FLEXIBLE, FLAT WORKPIECE OFF A SUPPORT SURFACE

The invention concerns a machine designed to lift a flexible, flat workpiece, especially a piece of material from a supporting surface, incorporating a holder for at least one needle that, by means of a control device, can be adjusted between a rest position, where the needle point comes to rest above the holder contact surface designed to touch the work piece to be lifted, and a working position where the needle protrudes down through a perforation slit in the contact surface at least partially beyond it.

Lifting the pieces of material automatically from a surface creates certain difficulties, because owing to, for example, a high degree of air permeability, the pieces of material cannot be picked up by a suction lift, as it is possible for other such workpieces. A machine that lifts a single piece of material from a firm support surface, such as a table, is already known, where several inclined needles, running in opposite direction to one another, are arranged in the holder at such distance from each other that they diverge during the transition from the resting to the working position. When the contact surface of the holder is set down onto the piece of material and the needles have pierced the piece of material, it can be lifted, because it cannot slip off the diverging needles. The application of this arrangement assumes that the piece of material lies on a soft surface which the needles can pierce when they lift the piece of material. This machine is not suited to pick up single pieces of material from a stack, because, when the needles pierce the uppermost piece of material, they would also penetrate the pieces of material lying below it, making it practically impossible to lift an individual piece of material from the stack.

The task of the invention is to design a machine of the kind described above, making it possible to automatically always pick up the uppermost workpiece from a workpiece stack.

The solution offered by the Invention allows the needle to just superficially perforate the workpiece to be lifted and then to run parallel to the workpiece plane before the needle point emerges again from the workpiece on the side on which it perforated it. When the needle is swung back into its rest position, it is pulled out of the workpiece again so that it can be laid down. It has been surprisingly demonstrated that this extremely simple machine can lift pieces of material of, for instance, different quality and thickness, from a stack perfectly, without incurring the danger of picking up two or more pieces of material.

The adjustment of the needle can be done in various ways, as, for instance, by means of an air pressure cylinder, where the needle is preferably prestressed in its rest position by a spring so that the control device need only by used to re-set the needle into the working position.

The rotation angle of the needle motion is preferably chosen so that, in both end positions, the needle comes to rest above the contact surface. This ensures that the workpiece hanging from the needle cannot slide off the needle during transportation from a pick-up place to the drop-off point. This is further ensured because the perforation slit in the direction of the needle motion is dimensioned in such a way that the edges of the perforation running acros the direction of the needle motion are very close to the motion path of the needle. On one hand, the lifted workpiece can thus not slip off the needle point, even if a certain traction is exercised, because the edge of the perforation slit of the contact surface would prevent this from happening. On the other hand, the workpiece is safely pushed off the needle, when the needle returns into its rest position, so that the workpiece cannot remain hanging on the needle.

When setting the contact surface of the holder down onto the workpiece to be picked up, care must be taken to avoid that it forms a fold within the area of the needle motion directed across the motion path of the needle, since otherwise the danger might arise that the needle would penetrate several workpieces simultaneously. That is reliably prevented by the fact that the width of the perforation slit, measured across the direction of the needle motion, is slightly larger than the greatest needle diameter. In this way, the perforation slit need be designed only as a narrow slit that only just allows the needle to pass so that a fold of workpiece material running across the direction of the slit cannot slip into the slit.

To ensure that the needle always lifts one workpiece only, and does not penetrate through it into the next workpiece, the distance of the needle motion path axis from the contact surface must preferably be chosen so that the needle protrudes down approximately by a needle thickness beyond the contac surface when it is in its rest position.

The needle is preferably attached to a needle carrier pivoting in the holder that can be turned through a chosen rotation angle by means of a control device. This allows easy replacement of the needle, when necessary. The distance between the needle carrier and the contact surface can be adjusted by the distance by which the needle protrudes from the contact surface to adapt to the different strength and quality of the workpieces to be picked up. To prevent the formation of a workpiece fold even when the perforation slit is not designed as a small slit running in the direction of the needle motion, the needle carrier can be connected to a material retainer that, considered from the direction of the needle motion, is positioned in front of the needle point with its end surface touching the motion path of the needle. When the contact surface is laid on the workpiece to be lifted, the workpiece retainer presses on the workpiece to be picked up and prevents the formation of a workpiece fold in front of the needle point in the area of the perforation slit. When the needle is set to the work position, the movement causes the workpiece retainer to smooth the workpiece so that the needle can only superficially penetrate the workpiece. The needle and/or the workpiece retainer can be adjusted relative to one another in direction of the needle motion.

The needle carrier is preferably designed as a circular disc pivoting in a case, incorporating a circumference groove to receive the needle as well as a straight circumference section stretching across a slightly wider angle sector than the curved needle section designed to perforate the workpiece. Such a needle holder is very simple to manufacture. The needle can be simply attached in the circumference groove of the circular disc so that it can be adjusted in the direction of the circumference of the circular disc. The retainer can, in this case, be formed by the cam or the corner formed at the transition from the circle circumference and the straight disc section.

The reliability of the machine according to the invention can still be increased by providing several needles that can be designed to pivot around a common axis. The needles can be arranged to move in the same or in opposite directions. In the latter case, the needles act as forceps that totally excludes the possibility of the workpiece falling off the needle, unless the workpiece be torn off the needles. If larger workpieces need to be lifted, several of the machines described above can be provided in any optional arrangement where a number of needles can also be controlled by a common control device.

Further characteristics and advantages of the invention follow from the following description that, together with the included drawings, explains the preferred embodiments of the invention.

Figure 1:
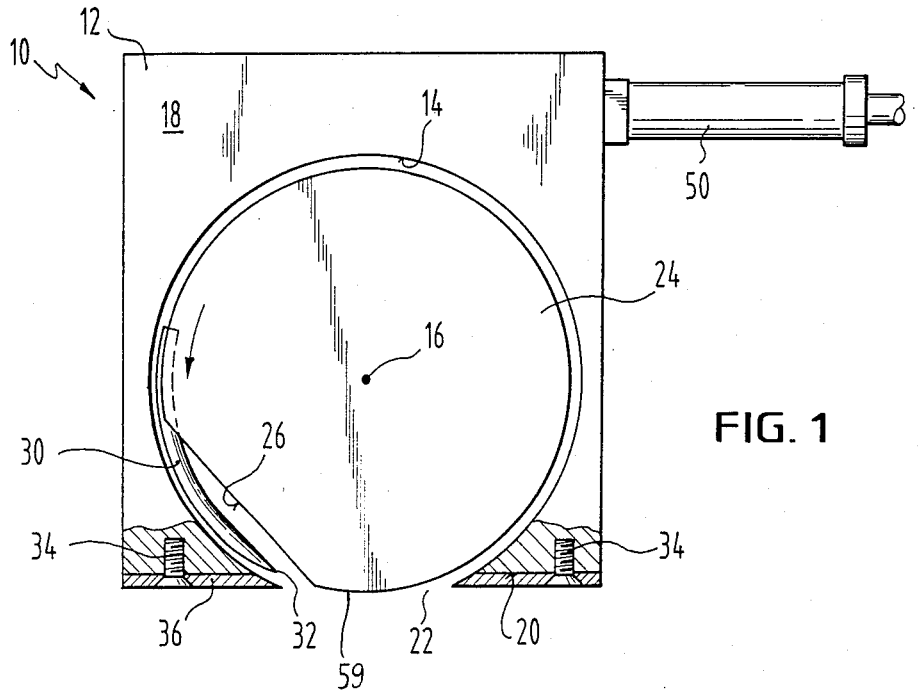
FIG. 1 shows a partially schematic section through a machine according to the invention, perpendicular to the needle rotation axis where the needle is in the rest position.

The machine illustrated in FIGS. 1 through 4, generally numbered 10, is used to lift the uppermost piece of material from a stack of material pieces. It includes a block shaped housing 12 designed as a flat square with a flat cylindrical opening 14 whose axis 16 is set perpendicular to the large lateral surfaces 18 of the housing 12. The opening 14 is designed in the housing 12 so that its circumference surface forms an edge surface 20 running parallel to the axis 16 and an opening 22.

Figure 2:
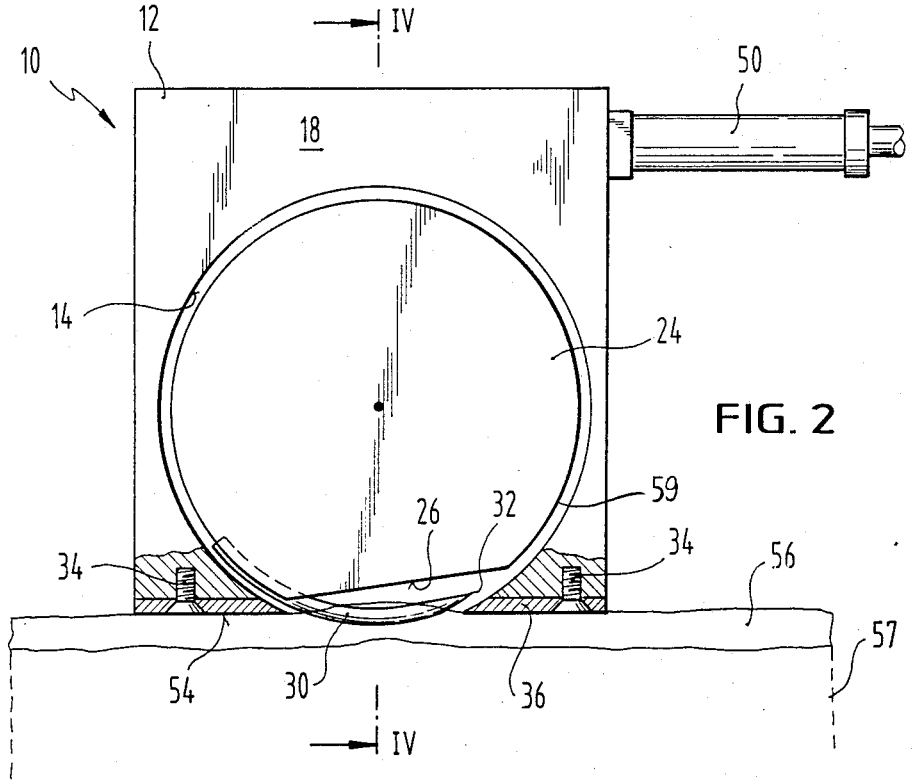
FIG. 2 shows a view of the needle in the work position corresponding to the view in FIG. 1.

A circular disc 24 pivots around the axis 16 in the cylindrical opening 14. The circular disc 24 has a straight circumference section 26 simply illustrated in FIGS. 1 and 2 as a circular chord that need, however, not necessarily run straight. Further, the circular disc 24 is furnished with a circumference groove 28 (FIG. 4) that, by means not illustrated, holds a needle 30, curved into a circle, in such a way that, together with a curved front section of the needle extending the needle point 32, it stretches across the greatest part of the straight circumference sector 26 of circular disc 24, as illustrated in FIGS. 1 and 2. The needle 30 can be firmly attached or also adjustably connected to the circular disc 24, forming a needle carrier, in the direction of the arrow in FIG. 1. Attached to the edge surface 20 of housing 12 by means of screws 34 is a plate 36 that has a narrow slit 38 near the opening 22 through which the curved front section of the needle 30 can glide, as illustrated in FIG. 4.

Figure 3:
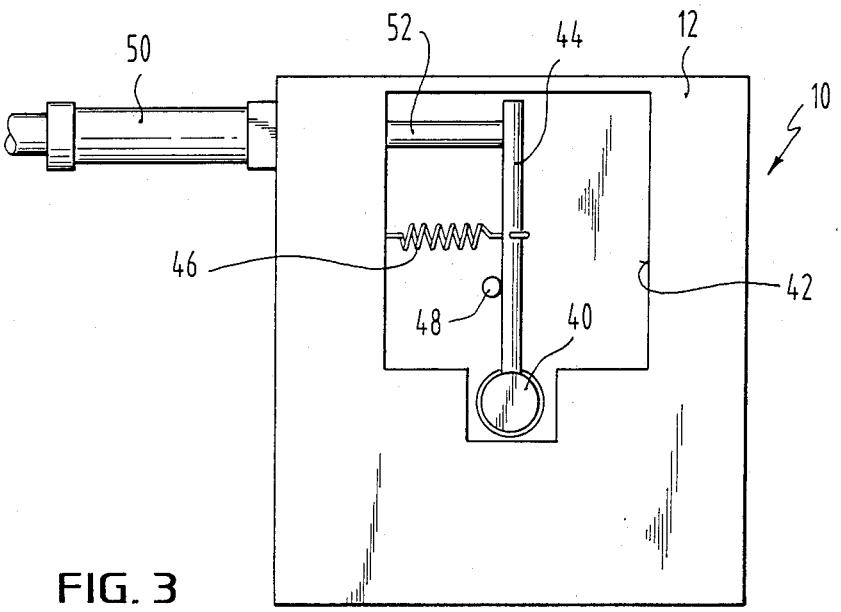
FIG. 3 shows a rear view of the machine illustrated in FIGS. 1 and 2.
Figure 4:
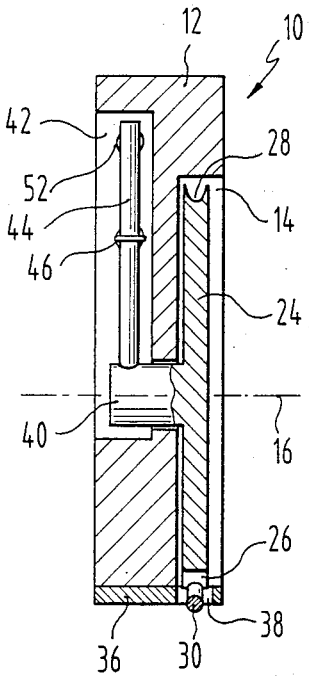
FIG. 4 shows a section along the line IV—IV in FIG. 2.

As can be seen in FIGS. 3 and 4, the circular disc 24 is fixed in the housing 12 by means of a pin 40, that is built as part of the circular disc 24 in this example. The free end of the pin 40 protrudes into a further opening 42 of the housing 12 that is open on the side 18 of the housing 12 opposite the opening 14. The pin 40 is connected with a radially designed lever 44 that is tension held counterclockwise against a dog 48 by means of a tension spring 46 in FIG. 3. To the housing 12, furthermore, an air pressure cylinder 50 is attached with a piston rod 52 that protrudes into the opening 42 of the housing 12 through a non-illustrated perforation in the housing, gripping the lever 44 with its free end. When the piston rod 52 is pushed out, the lever 44 in FIG. 3 is swung clockwise causing the circular disc 24 to rotate around the axis 16 and thereby the needle 30 to move from its rest position illustrated in FIG. 1 into the work position illustrated in FIG. 2. When, during this position adjustment, the machine 10 with its free contact surface 54 of the plate 36 comes to rest on the uppermost piece of material 56 of a pile 57 of pieces, during the transition from the rest position to the work position, the needle 30 perforates at least superficially into the piece of material so that, when reaching the end position, the needle point 32 emerges from the piece of material on the same side of the material. Because, in its work position, the needle 32 rests again inside the housing 12 (FIG. 2), and the edges of the slit 38, directed across the motion path of the needle 30, come close to the motion path of the needle 30, the piece of material 56 cannot slide off the needle 30. In the position illustrated in FIG. 2, the piece of material 56 can now be picked up by the machine 10 and be transported to a drop-off surface anywhere where the piece of material is released, because, following pressurization of the air pressure cylinder 50 by action of the spring, the circular disc 24 and therefore also the needle 30 return into the rest position illustrated in FIG. 1. A comparison of FIGS. 1 and 2 shows easily that the piece of material 56 is brushed off the needle 30 when it returns to its rest position, ensuring that the piece of material 56 does not remain hanging on the needle 30.

As illustrated in FIGS. 1 through 4, during its transition from its rest position to its work position, the needle 30 emerges a little from the slit 38, so that it protrudes beyond the contact surface 54 formed by the free side of the plate 36. The amount by which the needle 30 protrudes beyond the contact surface 54 in its work position depends primarily on the thickness of the piece of material to be lifted. Experience has surprisingly shown that, with the same setting of the needle 30 in relation to the contact surface 54, pieces of material of different quality and thickness can be lifted, without incurring the danger that two or more pieces of material are pierced at the same time, or that, on the other hand, the piece of material cannot not be sufficiently grasped by the needle. If, however, a change of adjustment is required, this can be easily done by exchanging a different plate 36 with a different width on the edge surface 20.

As can be easily seen in FIG. 1, when the machine 10 comes to rest on the stack 57, the piece of material 56 is pressed down by the circular disc 24 around the slit 38. The transition range or leading edge portion 59 of the circular circumference of disc 24 immediately preceding the needle point 32 acts as a retainer smoothing the surface of the material in front of the needle point during the setting of the needle 30 from its rest position to its work position, thus preventing that the compression of the machine 10 onto the stack 57 could create a fold involving several layers of material around the slit 38 that could invade the slit 38. If this were to be the case, the needle 30 could pierce several layers of material with the result that then several pieces of material would be simultaneously lifted off the stack 57. The distance between the needle point 32 and the edge portion 59 is chosen so that only just enough material of the piece of material 56 to be picked up can push into the gap to enable the needle to grasp it. By adjusting the needle 30, this distance can be adjusted as needed, both to the quality as well as the thickness of the piece of material.

Figure 5:
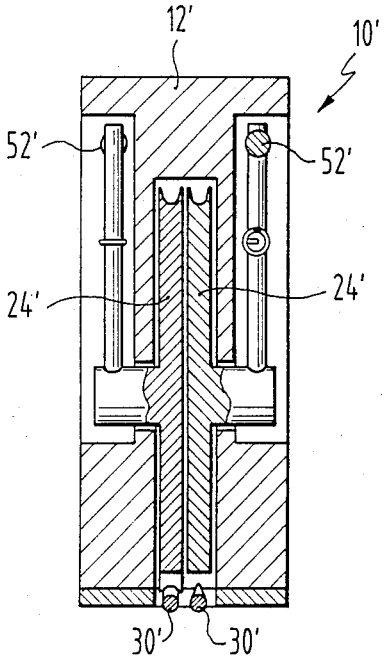
FIG. 5 shows a section corresponding to FIG. 4 through a second embodiment of the Invention with two adjustable needles running in opposite directions.

It is therefore obvious that, to further guarantee the lifting operation of larger pieces of material, circular discs or needle holders for several needles 30 can also be provided arranged in axially adjoining grooves 28. FIG. 5 shows an example in which two circular discs 24' are co-axially arranged in a housing 12', each carrying a needle 30'. The arrangement is designed so that the circular discs 24' are adjustable in opposite directions of rotation around an axis 16', each time with the help of compressed air cylinder 50' so that the needles 30' move, forceps like, towards or away from each other. Coupling the compressed air piston 50' with the circular discs 24' is done by the method illustrated in FIGS. 3 and 4.

Figure 6:
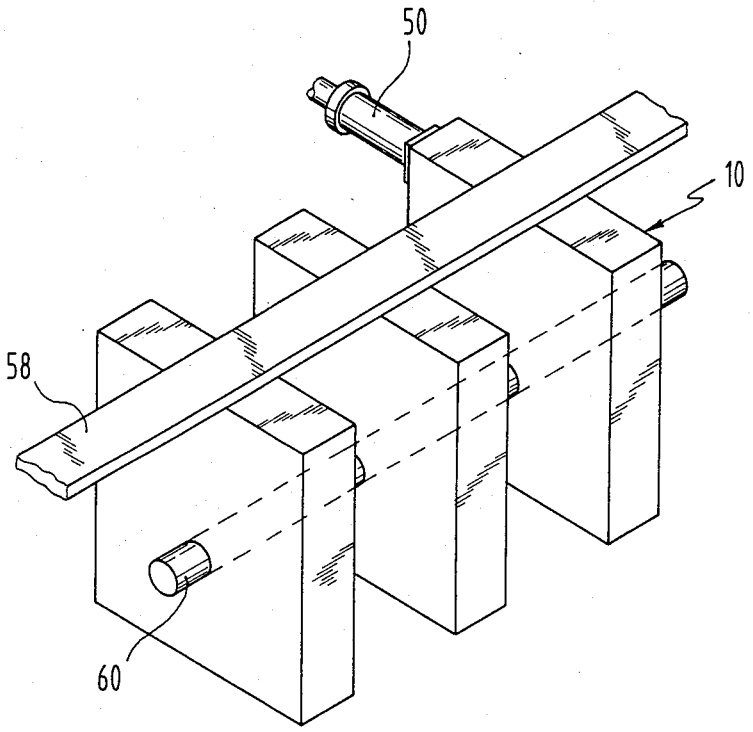
FIG. 6 shows an arrangement for picking up larger work pieces by using several machines of the type described in FIGS. 1 through 4.

To lift large pieces of material from a stack, several machines 10 or 10', respectively, described in FIGS. 1 through 4 or in FIG. 5, respectively, can be attached to an appropriate carrying frame 58 in any optional arrangement. The circular discs 24 of several machines 10, designed coaxially to each other, can be connected together by a common shaft 60 so that a single compressed air cylinder 50 is sufficient to synchronize the circular discs 24 of the coupled machines as schematically illustrated in FIG. 6.

The essential advantage of the solution according to the invention, consists therein that the uppermost piece of material can be lifted off a stack of pieces of material automatically, without incurring the danger that two or several pieces of material will be picked up simultaneously. It is understood that the housing 12 need not be built as a block nor the needle holder as a circular disc. It suffices if a contact surface with an opening corresponding to the opening, or respectively, to the slit 38 and when a needle, curved into a circular shape and adjustable on a circular path is arranged relative to the contact surface in such a relative to the contact surface in such a way that, moving along its circular path of motion, it superficially perforates the workpiece to be lifted and emerges again on the same side of the workpiece.

Figure 7:
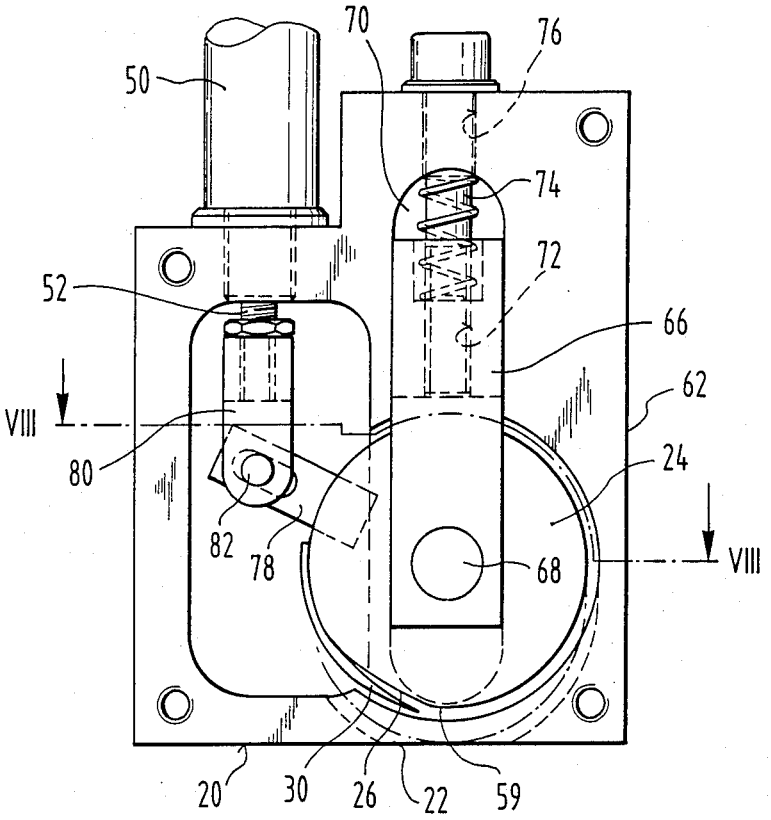
FIG. 7 shows a side view of a particularly preferred embodiment of the machine according to the invention without a housing cover.
Figure 8:
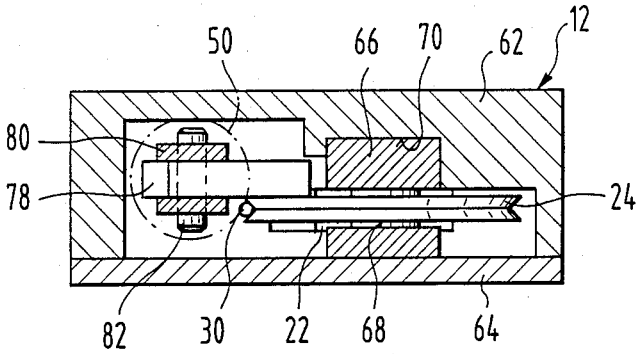
FIG. 8 shows a section along the line VIII—VIII in FIG. 7 with a housing cover.

FIGS. 7 and 8 illustrate a specially preferred example of the machine according to the invention, that differs in several details from the machine illustrated in FIGS. 1 through 4. Equivalent parts are, however, identified with the same references and are not further explained.

An essential difference from the example described in FIGS. 1 through 4 consists in the fact that the housing 12 is enclosed. The housing 12 encloses a body 62 into which the disc shaped needle carrier 24 is designed and a lid 64, closing the body (FIG. 8). The assembled housing 12 only shows the opening 22 through which the needle 30 can pass.

The disc shaped needle holder 24 does not pivot directly on the body 62, but on a fork stem 66 by means of a pin 68. The fork stem 66 sits adjustably perpendicular to the edge surface 20 of the body 62 in an opening 70 of the body 62 and is furnished with a threaded opening 72 at its upper end that receives an adjusting screw 74 passing through a perforation 76 in the body 62, parallel to the adjustment direction of the fork stem. By turning the adjusting screw 74, the fork stem 66 in FIG. 7 can be moved up and down to set the distance by which the needle 30 protrudes beyond the edge surface 20 when emerging through the opening 22. FIG. 7 shows the fork stem 66 adjusted completely upwards.

The disc shaped needle carrier 24 is connected with a radially orientated lever 78, that itself is connected by a joint with a fork stem 80 connected by a rod with a long slot. The fork stem 80 is attached to the free end of the piston rod 52 of the work cylinder 50. The machine illustrated in FIGS. 7 and 8 works, by the way, in exactly the same way as the machine illustrated in FIGS. 1 through 4. The totally enclosed housing has the advantage that the enclosed mechanism is protected against soiling and that it excludes any danger of the service personnel being injured by any moving parts.

I claim:

1. In a machine for lifting a flexible, flat workpiece, said machine including a housing with a slit therein and a needle for passing through the slit and piercing the workpiece, wherein the improvement comprises:

needle holder means for holding said needle, said holder being generally disc shaped having an axis and an outer circumference, the outer circumference including a circular portion and a sector cut out from the circular circumference portion of the holder, said needle being circular having one end mounted to the holder on the circumference thereof such that the needle bridges the main part of the sector with the point of the needle being spaced by a gap of a preselected distance from a leading edge portion of the circular circumference portion of the holder;

means for mounting the needle holder to the housing such that the leading edge of the holder protrudes through the slit when the holder is in a rest position so as to push down on the workpiece to prevent folds from occuring in the slit when the machine is first placed thereon; and means for rotating said holder to cause the leading edge thereof to rotate out of contact with the workpiece and to cause the point of the needle to follow an arcuate path through the slit of sufficient length to pierce the workpiece whereby the machine can be raised to lift the workpiece and carry it to another location.

2. The improvement of claim 1 wherein said holder includes a circumferentially located groove therein, with said one end of the needle being mounted in the groove.

3. The improvement of claim 1 wherein said means for rotating said holder is adapted to cause the point of the needle to stop at a position located above the slit in the housing.

4. The improvement of claim 3 which further comprises:

means for returning the needle holder to its rest position.

5. The improvement of claim 1 wherein said means for rotating includes a moveable rod connected to the needle holder by at least one link.

6. The improvement of claim 5 wherein said needle holder is biased in its rest position with the needle point being located within the housing above the slit.

7. The improvement of claim 1 wherein the entire circumference of said needle holder is circular except for said sector which is defined by a straight chord.

8. The improvement of claim 1 which further comprises:

means for adjusting the distance that the needle protrudes through the slit.

9. The improvement of claim 8 wherein said means for adjusting includes a fork stem to which the needle holder is pivotally connected, and means for adjusting the position of the fork stem relative to the slit.

10. The improvement of claim 1 which further comprises a plurality of needles rotating about said axis.

11. The improvement of claim 10 wherein said plurality of needles are set against each other and are driven in opposite directions.

12. The improvement of claim 11 wherein each of said needles is mounted to its own needle holder, and wherein all of the needle holders are rotated by a common driving device.

* * * * *